United States Patent [19]

Bodine

[11] 4,023,628

[45] May 17, 1977

[54] DRILLING DEVICE UTILIZING SONIC RESONANT TORSIONAL RECTIFIER

[76] Inventor: Albert G. Bodine, 7877 Woodley Ave., Van Nuys, Calif. 91406

[22] Filed: Apr. 30, 1976

[21] Appl. No.: 682,017

[52] U.S. Cl. ..... 175/56; 175/106; 408/17; 408/700

[51] Int. Cl.[2] ..... E21C 3/06

[58] Field of Search ..... 175/55, 56, 106; 173/93, 93.5, 93.6, 93.7; 37/DIG. 18; 172/40; 408/17, 700; 299/14, 37; 30/272 R, 45

[56] References Cited

UNITED STATES PATENTS

| | | | |
|---|---|---|---|
| 2,713,992 | 7/1955 | Snyder | 175/56 |
| 2,906,502 | 9/1959 | Smith | 175/56 X |
| 2,911,192 | 11/1959 | Boucher | 175/56 |
| 3,468,384 | 9/1969 | Bodine | 30/272 R X |
| 3,480,092 | 11/1969 | Reinold | 173/93 X |
| 3,610,347 | 10/1971 | Diamantides | 175/56 |
| 3,633,688 | 11/1972 | Bodine | 175/55 |

*Primary Examiner*—Ernest R. Purser
*Assistant Examiner*—Richard E. Favreau
*Attorney, Agent, or Firm*—Edward A. Sokolski

[57] ABSTRACT

Torsional sonic energy is generated by means of a sonic generator and coupled to an elastic member to cause torsional resonant vibration thereof. The output of the torsional resonant member is coupled through an acoustic rectifier device to a drilling bit to simultaneously provide both torsional and vertical drive components to the bit to effect a spiral "screw" type driving action thereof. The rectifier action results in unidirectional high level pulses of the resonant sonic energy to the bit, causing the bit to be driven both rotatably and downwardly in a pulsating manner.

6 Claims, 4 Drawing Figures

DRILLING DEVICE UTILIZING SONIC RESONANT TORSIONAL RECTIFIER

This invention relates to a sonic drilling device and more particularly to such a device using acoustical rectification which provides unidirectional drive pulses to a drill bit having both torsional and longitudinal components.

In my U.S. Pat. No. 3,633,688, issued Jan. 11, 1972, a torsional rectifier drilling device suitable for use in drilling into the ground or the like is described, in which torsional sonic energy generated in a resonant vibration system is coupled to a cutting tool in unidirectional torsional pulses such as through rectifier hammers which strike against the sides of associated windows. In the device of this prior patent, the drive of the cutter is solely torsional, i.e., about the longitudinal axis thereof, there being no significant longitudinal drive force provided along or parallel to the cutter's longitudinal axis. It has been found that significantly improved cutting action can be obtained by providing a longitudinal component of force to the cutter through the rectifier, in addition to the torsional drive. The provision of this longitudinal component of force, it has been found, better acoustically couples the resonant tool system to the acoustic reactance of the material being drilled, thus enabling the system to sense the reactive responses of the load material and to respond thereto to provide more effective drilling action. The provision of a downward component in addition to the rotary component to the rectifier output makes for a spiral drive force to the bit, giving it a screw-type action.

The present invention provides an improvement over that of my U.S. Pat. No. 3,633,688 in providing the aforementioned desirable longitudinal component in the rectifier output in addition to the torsional drive, in a simple, highly efficient manner.

Referring to the drawings.

Figure 1:
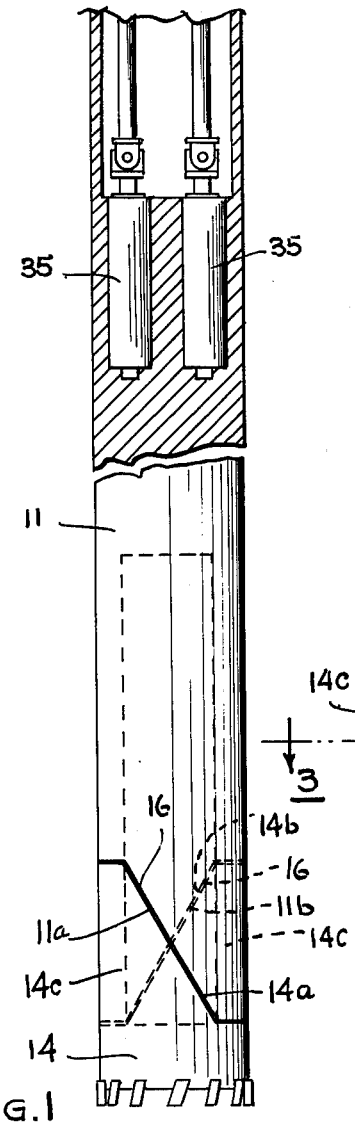
FIG. 1 is an elevational drawing of a preferred embodiment of the invention.

Briefly described, the device of my invention is as follows: The output of a torsional sonic oscillator is coupled to a drill stem to effect torsional resonant vibration thereof. In the preferred embodiment, the torsional vibrational output of the drill stem is coupled through a rectifier mechanism to provide a unidirectional driving force to a drill bit, this force having both torsional and downward drive components, in the nature of screw action. In the preferred embodiment this end result is achieved by supporting the bit from the drill stem on a torsional spring member using a spline connection, in a manner such that a small degree of longitudinal freedom of movement relative to the drill stem is provided. A sloping rectifier gap is formed between the drill stem and a portion of the bit support structure, this end result being achieved by means of opposed sloping surfaces appropriately formed on opposing portions of these structures. The torsional spring member provides a certain degree of vibrational isolation of the bit from the drill stem from which it is suspended, unidirectional pulses of sonic energy having both torsional and downward components of force being coupled to the bit through the rectifier gap. There thus is a downward force reactance component between the bit and the load and back from the drilling load to the bit, which greatly increases the elastic fatigue to which the drilling load is subjected. In a second embodiment the downward force component is achieved by forming sloping pillars in the resonantly driven drill stem.

It has been found most helpful in analyzing the device of this invention to analogize the acoustically vibrating circuit utilized to an equivalent electrical circuit. This sort of approach to analysis is well known to those skilled in the art and is described for example in Chapter 2 of "Sonics" by Hueter and Bolt, published in 1955 by John Wiley and Sons. In making such an analogy, force F is equated with electrical voltage E, velocity of vibration $u$ is equated with electrical current $i$, mechanical compliance $C_m$ is equated with electrical capacitance $C_e$, mass M is equated with electrical inductance L, mechanical resistance (friction) $R_m$ is equated with electrical resistance R, and mechanical impedance $Z_m$ is equated with electrical impedance $Z_e$.

Thus, it can be shown that if a member is elastically vibrated by means of an acoustical sinusoidal force $F_o \sin\omega t$ ($\omega$ being equal to $2\pi$times the frequency of vibration) that $$Z_m = R_m + j\left(\omega M - \frac{1}{\omega C_m}\right) = \frac{F_o \sin\omega t}{u} \qquad (1)$$

Where $\omega M$ is equal to $(1/\omega C_m)$, a resonant condition exists and the effective mechanical impedance $Z_m$ is equal to the mechanical resistance $R_m$, the reactive impedance components $\omega M$ and $(1/\omega C_m)$ cancelling each other out. Under such a resonant condition, velocity of vibration $u$ is at a maximum, power factor is unity, and energy is more efficiently delivered to a load to which the resonant system may be coupled.

It is important to note the significance of the attainment of high acoustical "Q" in the resonant system being driven, to increase the efficiency of the vibration thereof and to provide a maximum amount of power. As for an equivalent electrical circuit, the "Q" of an acoustically vibrating circuit is defined as the sharpness of resonance thereof and is indicative of the ratio of the energy stored in each vibration cycle to the energy used in each such cycle. "Q" is mathematically equated to the ratio between $\omega M$ and $R_m$. Thus, the effective "Q" of the vibrating circuit can be maximized to make for highly efficient, high-amplitude vibration by minimizing the effect of dissipation in the circuit and/or maximizing the effect of mass in such circuit.

In considering the significance of the parameters described in connection with equation (1), it should be kept in mide that the total effective resistance, mass and compliance in the acoustically vibrating circuit are represented in the equation and that these parameters may be distributed throughout the system rather than being lumped in any one component or portion thereof.

It is also to be noted that orbiting mass oscillators are utilized in the implementation of the invention that automatically adjust their output frequency and phase to maintain resonance with changes in the characteristics of the load. Thus, in the face of changes in the effective mass and compliance presented by the load with changes in the conditions of the work material as it is sonically excited, the system automatically is maintained in optimum resonant operation by virtue of the "lock-in" characteristic of Applicant's unique orbiting mass oscillators. Furthermore, in this connection the orbiting mass oscillator automatically changes not only its frequency but its phase angle and therefore its power factor with changes in the resistive impedance load, to assure optimum efficiency of operation at all times. The vibrational output from such orbiting mass oscillators also tends to be constrained by the resonator to be generated along a controlled predetermined coherent path to provide maximum output along a desired axis.

Referring now to FIG. 1, a preferred embodiment of the invention is illustrated. Drill stem 11 is fabricated of an elastic material such as steel, and has a pair of rotors 35 mounted therein which are rotatably driven by appropriate drive means (not shown) to form an orbiting mass oscillator. The oscillator and its associated drive structure may be of the type described in my aforementioned U.S. Pat. No. 3,633,688, the rotors being unbalanced by virtue of hollow cores eccentric to their centers formed therein. When the rotors are rotatably driven, torsional elastic vibration of drill stem 11 results. Drilling bit 14 is elastically supported on drill stem 11 by means of a torsional bias spring member 22, as to be described in connection with FIG. 2. A pair of rectifier gaps 16 are formed by opposed sloping surfaces 14*a*, 14*b* on the bit structure, and 11*a*, 11*b* respectively on the drill stem (additionally see FIG. 3).

Figure 2:
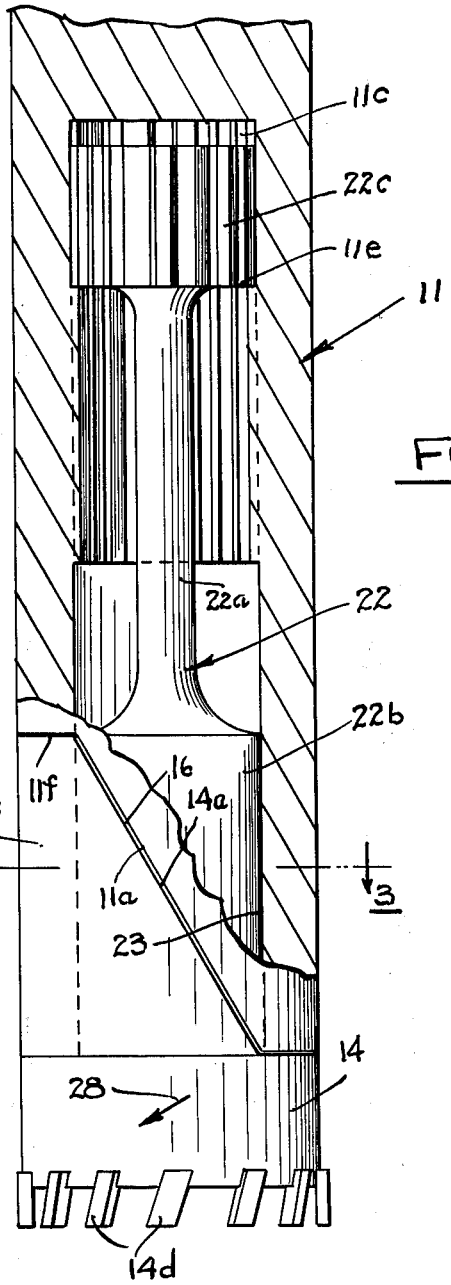
FIG. 2 is an elevational view partially in cutaway section illustrating the rectifier and the associated drive mechanism of the preferred embodiment.
Figure 3:
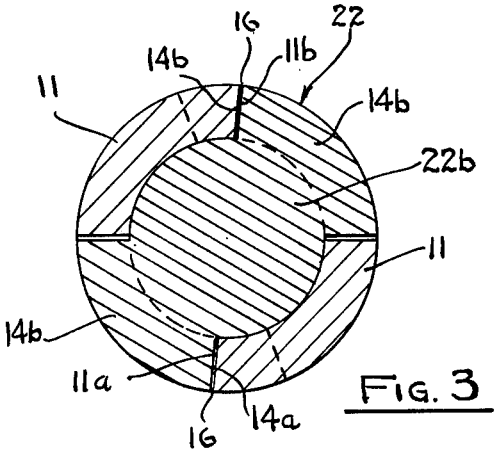
FIG. 3 is a cross sectional view taken along the plane indicated by 3—3 in FIG. 2.

Referring now to FIGS. 2 and 3, drill bit member 14 having coring teeth 14*d* is fixedly attached to the bottom portion 22*b* of torsion spring member 22 which is fabricated of a highly elastic material such as a suitable steel. The central portion 22*a* of the torsion spring member is thinned out to form a suitable torsion bar, while the upper portion 22*c* thereof is splined. Splined portion 22*c* engages a mating splined portion 11*c* formed in the inner wall of stem 11. Splined portion 22*c* bottoms against ledge 11*e* formed in the inner wall of the stem. A limited amount of vertical freedom is permitted for torsional spring member 22 by virtue of the fact that splined portion 11*c* is longer than splined portion 22*c*. The surface of bottom portion 22*b* of the torsion spring member abuts against the inner wall of stem 11, bearing surfaces 23 being formed between these two members which permits limited freedom of rotational and longitudinal movement therebetween. These surfaces may be lubricated or polished to minimize friction at their interfaces. Bit member 14 has a pair of tongue portions 14*c* which fit into slotted portions 11*f* formed at the bottom of the drill stem such that sloped surfaces 14*a* and 11*a*, and 14*b* and 11*b* are positioned in opposing relationship.

Rotors 35 are driven at a speed such as to set up resonant torsional vibration of drill stem 11. Torsion bias spring member 22 acts as a vibration isolator between the drill stem and the bit such that the transfer of torsional vibrational energy from the drill stem through member 22 to bit member 14 is minimized. Limited freedom of vertical movement of the torsion spring member is afforded by virtue of splines 11*c* and 22*c*, and the freedom of vertical movement provided at bearing surfaces 23. During each vibration cycle, rectifier gap 16 is closed and sloped surfaces 11*a* and 11*b* strike against sloped surfaces 14*a* and 14*b* respectively, thus effecting unidirectional drive of bit member 14 both torsionally and in the downward direction indicated by arrow 28.

It is to be noted that torsion spring member 22 operates to provide spring bias action which limits the size of rectifier gap 16. Further, this spring action tends to keep the gap closed after each drive pulse for a substantial portion of the cycle, and then opens only slightly. This assures that the rectifier gap closes at a time when there is considerable kinetic energy in the drive stroke of the resonant stem member.

It is desirable in the operation of the device to set down some of the weight of the resonant stem member against the bit. This keeps the splines 22*c* in their extreme upward position so that there is adequate freedom of vertical movement for the bit to be driven downwardly by the torsionally vibrating stem member.

Figure 4:
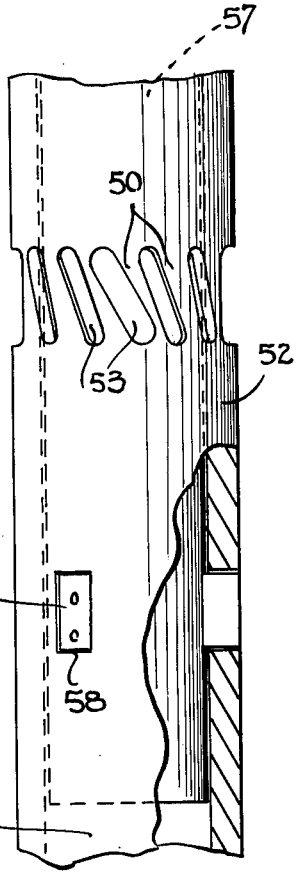
FIG. 4 is an elevational view illustrating another embodiment of the invention.

Referring now to FIG. 4, another embodiment of the invention is illustrated. This second embodiment is somewhat similar to that of FIG. 4 of the aforementioned U.S. Pat. No. 3,633,688 and utilizes a plurality of elastic pillars 50 formed in the wall of tool tube 52 which are spaced from each other by slots 53. In the device of the present invention, however, the pillars 50 are sloped rather than being vertical as in the device of my prior patent. The present device is otherwise identical to that described in connection with FIG. 4 of my aforementioned patent, with the bit 14 being attached to the tool tube and having rectifier hammers 56 which are attached to the drill stem 57 and which fit in windows 58 formed in tube 52. With the elastic pillars sloped as indicated, a longitudinal component of force is added to the torsional force provided by the hammers against the windows, this by virtue of the fact that the elastic pillars tend to straighten out and become more vertical as they are twisted by the torsional drive, just as the rectifier gap is closed.

The present invention thus provides an improvement over that of my prior patent by adding a longitudinal force to the torsional force of the bit against the rock or other material being drilled. This results in a sloping drive to the bit much like a twisting screw action with substantially improves the drilling action.

While the invention has been described and illustrated in detail, it is to be clearly understood that this is intended by way of illustration and example only and is not to be taken by way of limitation, the spirit and scope of this invention being limited only by the terms of the following claims.

I claim:

1. In a sonic drilling device, a torsionally elastic member, periodic torsional force means directly coupled to said member for torsionally oscillating said member about its longitudinal axis at a torsional resonant frequency, a cutting tool, and rectifier means coupled to said elastic member and located between the elastic member and the cutting tool for transmitting unidirectional pulses of sonic energy having torsional and longitudinal components from said member to said tool.

2. The device of claim 1 wherein said rectifier means comprises opposed sloping surfaces on said cutting tool and said elastic member forming a rectifier gap which slopes relative to the longitudinal axis of said tool.

3. The device of claim 1 and additionally comprising a tool tube member attached to said tool, said rectifier means being formed by opposed surfaces on said tool tube and said elastic member which are substantially parallel to the longitudinal axis of the cutting tool, and longitudinal elastic pillars formed in said tube, and pillars being sloped relative to the longitudinal axis of said tool tube whereby said tool tube imparts a longitudinal component of force to said bit when torsionally driven by said elastic member.

4. The device of claim 1 and including torsional spring means for supporting said cutting tool on said torsionally elastic member, said torsional spring means providing torsional vibrational isolation between said tool and said elastic member.

5. The device of claim 4 wherein said torsional spring means comprises a torsional spring member having a splined portion at one end, a bearing portion at the other end and a reduced diameter portion forming a torsion bar interconnecting said end portions, said elastic member having a hollow portion at the end thereof in which said torsion spring member is supported, said hollow portion having splines formed near the upper end thereof engaging the splined portion of said spring member, said bearing portion abutting against the inner wall of said hollow portion to form a bearing between said last mentioned portions permitting limited freedom of rotational and longitudinal movement therebetween.

6. The device of claim 5 wherein the splines of said hollow portion have a greater longitudinal extent than the splined portion of said spring member, thereby providing limited freedom of longitudinal movement between the splines and splined portion.

* * * * *